United States Patent [19]

Leinonen

[11] 4,075,548

[45] Feb. 21, 1978

[54] STABILIZED VOLTAGE SOURCE HAVING A SERIES REGULATOR ON THE ALTERNATING-VOLTAGE SIDE

[75] Inventor: Erkki Ilmari Leinonen, Vantaa, Finland

[73] Assignee: Outokumpu Oy, Outokumpu, Finland

[21] Appl. No.: 736,084

[22] Filed: Oct. 27, 1976

[30] Foreign Application Priority Data

Oct. 27, 1975 Finland ..... 752994

[51] Int. Cl.[2] ..... G05F 1/48

[52] U.S. Cl. ..... 323/86; 323/88

[58] Field of Search ..... 323/22 T, 86, 87, 88

[56] References Cited

U.S. PATENT DOCUMENTS 2,638,571 5/1953 Schultz ..... 323/86

3,070,743 12/1962 Harper ..... 323/86

3,815,015 6/1974 Swin et al. ..... 323/22 T

*Primary Examiner*—Gerald Goldberg

*Attorney, Agent, or Firm*—Brooks, Haidt, Haffner & Delahunty

[57] ABSTRACT

A stabilized voltage source having a series regulator on its alternating-voltage side in order to eliminate variations in the load voltage, wherein the series regulator includes a transformer having a primary coil connected in series between the power supply and the load, and a feed-back circuit including a voltage-controlled resistance connected across a secondary coil of said transformer and a control circuit for controlling said voltage-controlled resistance according to the difference between the actual load voltage and a reference voltage corresponding to the desired load voltage. Preferably, the control circuit comprises a differential amplifier.

1 Claim, 2 Drawing Figures

STABILIZED VOLTAGE SOURCE HAVING A SERIES REGULATOR ON THE ALTERNATING-VOLTAGE SIDE

BACKGROUND OF THE INVENTION

1. Field of the Invention

The present invention relates to a stabilized voltage source having a series regulator connected on its alternating-current side in order to eliminate variations in the load voltage.

2. Description of the Prior Art

The existing series regulators with alternating current are so-called trigger components, previously gas-filled thyratron tubes, nowadays thyristor-type semiconductor components or magnetic amplifiers. These regulators are characterized by the production of harmonic frequency components of the regulated alternating quantity during the regulation; the frequency components dissipate into the environment and pass into the load, and are usually detrimental to the operation of the devices.

SUMMARY OF THE INVENTION

The present invention provides a stabilized series regulated voltage source of alternating voltage, said voltage source comprising a transformer having a primary coil and a secondary coil, said primary coil being connected between an alternating voltage power input and the load terminal, control circuit means having one input connected to a voltage dependent on the actual load voltage and another input connected to a reference voltage corresponding to the desired load voltage, said control circuit means producing an output voltage dependent on the difference between the input voltages thereof, and voltage controlled resistance means controlled by the output voltage of said control circuit means and connected across the secondary coil of said transformer.

The object of the present invention is, by utilizing known electronic components, to provide a stabilized voltage source having a series regulator for the alternating-current quantity, which does not produce the harmonic frequencies characteristic of known regulators.

Thus, according to the invention, a voltage-controlled resistance is introduced into the power-supply conductor of the voltage source by means of a transformer, the resistance being regulated by means of a control voltage dependent on the output voltage of the voltage source in such a manner that the output voltage remains at a constant value determined by the reference value of the control circuit.

DESCRIPTION OF THE PREFERRED EMBODIMENTS

Figure 1:
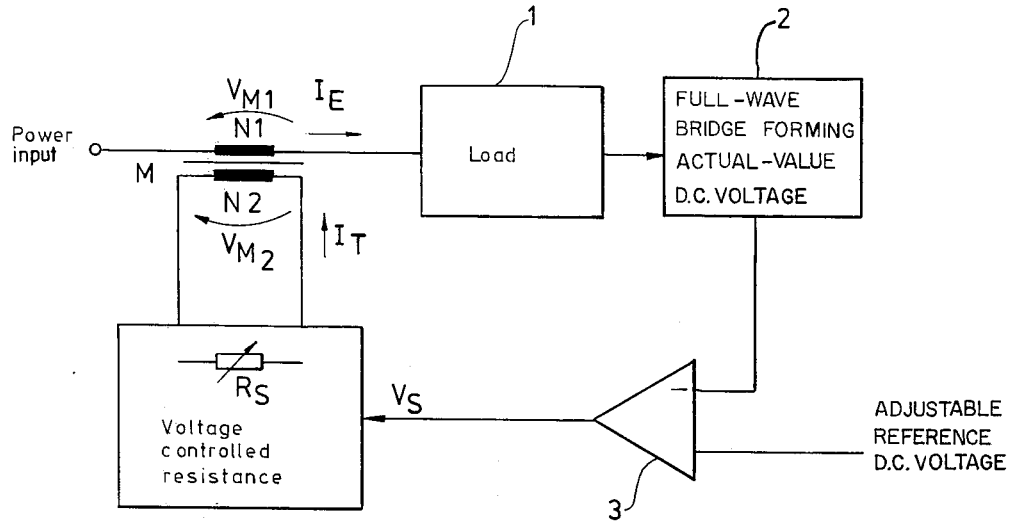
FIG. 1 shows a block diagram of a stabilized voltage source according to the invention.

The block diagram in FIG. 1 illustrates a typical circuit arrangement of a stabilized voltage source. Power supply into the load 1 takes place through the primary side of the transformer M. In the circuit 2 a direct actual-value voltage is formed from the voltage of the load and is introduced into one of the input terminals (−) of the differential amplifier 3. This actual-value voltage may be obtained, as well known, e.g. by simply full wave rectifying of the load voltage. A reference value, being suitably an adjustable stable voltage, is introduced into the other input terminal. The amplified difference ($V_s$) between the reference value and the actual value regulates a voltage-controlled resistance $R_s$. The transformer M transfers the resistance into the power supply conductor. The current consumed by the load causes a loss of voltage in the resistance, and this voltage loss is regulated by means of the voltage $V_s$ in such a manner that the voltage of the load remains that determined by the reference value.

It is assumed that the transformer M is without dissipation and does not draw a magnetizing current. In this case the following equations can be written:

$$I_E \cdot N_1 = I_T \cdot N_2$$

$$(V_{M2}/V_{M1}) = (N_2/N_1)$$

On the basis of them, the following equation is obtained:

$$V_{M1} = (N_1/N_2)^2 \cdot I_E \cdot R_s$$

The following value is obtained for the resistance observable on the primary side of the transformer:

$$\partial(V_{M1}/\partial I_E) = (N_1/N_2)^2 \cdot R_s \qquad \text{(I)}$$

This last equation requires that $R_s$ is independent of the current $I_E$.

It is observed that when the resistance $R_s$ is transferred by means of the transformer M from the secondary side to the primary side, the value of $R_s$ is multiplied by the square of the transformation ratio.

Since $\partial V_{M1}/\partial I_E$ is constant (independent of the current, as is $R_s$), no harmonic frequency components are produced when the current $I_E$ passes through the transformer.

Figure 2:
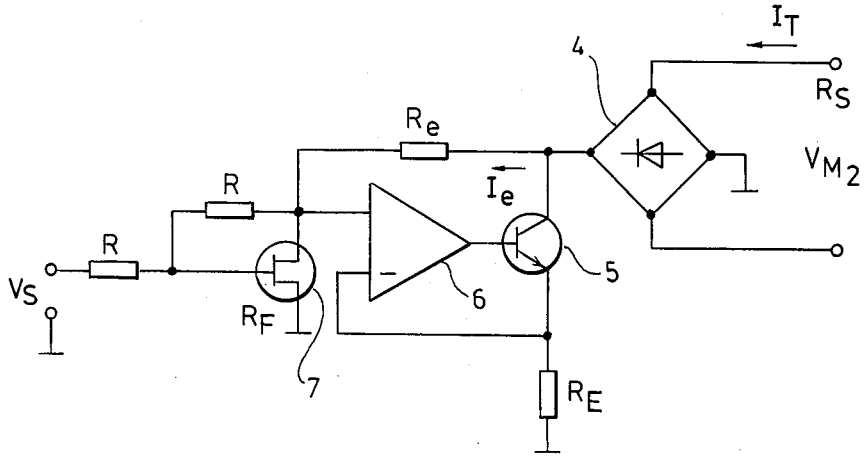
FIG. 2 shows a wiring diagram for the formation of a voltage-controlled resistance.

FIG. 2 illustrates the wiring for producing a resistance $R_s$ the value of which can be regulated by changing the direct control voltage $V_s$ in the feed-back loop. The current $I_T$ is passed through the rectifier bridge 4 and the transistor 5. If $I_e << I_T$ and the amplification of the differential amplifier 6 is large, the following equation can be produced with this wiring:

$$V_{M2} = R_E(1 + (R_e/R_F)\, I_T \qquad (2)$$

$R_F$ is the drain-source resistance of the FET-transistor 7 used in the wiring, and it is characterized by a good linearity with low values of the drain-source voltage. The following equation is approximately valid for $R_F$ (when $|V_s| < |V_p|$)

$$R_F = \frac{V_p^2}{2I_{DSS}(V_s - V_p)} \qquad (3)$$

In this equation, $R_F$ = drain-source resistance of the FET-transistor, $V_p$ = pinch-off voltage of FET-transistor, and $I_{DSS}$ = drain-source saturation current ($V_{Gs}$ = 0).

By placing the expression (3) for $R_F$ into the expression (2) for $V_{M2}$, the following equations are obtained:

$$V_{M2} = R_E\left(1 + \frac{2I_{DSS} \cdot R_s(V_s - V_p)}{V_p^2}\right) I_T \quad (4)$$

and $$\frac{\partial V_{M2}}{\partial I_T} = R_E\left(1 + \frac{2I_{DSS} \cdot R_s(V_s - V_p)}{V_p^2}\right) = R_s$$

From this it can be seen that $R_s$ is a function of $V_s$. Thus a direct-voltage-controlled linear resistance component has been produced, the resistance of which can be transferred by means of a transformer to the alternating-current side of a power-supply conductor in such a manner that it tends to resist any changes in the load voltage. The rest of the voltage source includes conventional circuit technology only.

What is claimed is:

1. A series regulated stabilized alternating voltage source, which comprises:

a transformer having a primary coil and a secondary coil, said primary coil being connected between an alternating voltage power input and a load terminal;

a feedback circuit connected between a load output and, said transformer for providing a resistance in the secondary coil of the transformer which is linearly dependent upon a control voltage, said feedback circuit including means for rectification and smoothing of load output voltage to provide an actual-value DC voltage proportional to said load output voltage, means for providing an adjustable reference DC voltage, a differential amplifier having inputs receiving said actual-value and reference voltages for amplifying the difference between said voltages to produce a control voltage, an FET transistor connected to an output of said differential amplifier, further amplifier means connected to said FET transistor and a rectifier bridge connected between said further amplifier means and the secondary coil of said transformer for transferring to said secondary coil a drain-source resistance of said FET transistor, which resistance is essentially linearly dependent upon the control voltage applied thereto by said differential amplifier.

* * * * *